United States Patent [19]

Aley et al.

[11] 4,273,048

[45] Jun. 16, 1981

[54] SURFACE-LAUNCHED FUEL-AIR EXPLOSIVE MINEFIELD CLEARANCE ROUND

[75] Inventors: Michael H. Aley, China Lake; James A. Bowen, Inyokern; Cecil A. Glass, China Lake, all of Calif.

[73] Assignee: The United States of America as represented by the Secretary of the Navy, Washington, D.C.

[21] Appl. No.: 24,132

[22] Filed: Mar. 26, 1979

[51] Int. Cl.[3] ..... F42B 3/00

[52] U.S. Cl. ..... 102/363; 102/374; 102/489

[58] Field of Search ..... 102/6, 22 R, 34.1, 90

[56] References Cited

U.S. PATENT DOCUMENTS

| | | | |
|---|---|---|---|
| 3,596,603 | 8/1971 | Gryting et al. | 102/90 |
| 3,685,453 | 8/1972 | Hamrick | 102/90 |
| 3,724,319 | 4/1973 | Zabelka et al. | 102/6 X |
| 3,940,443 | 2/1976 | Glass | 102/6 |
| 3,955,509 | 5/1976 | Carlson | 102/90 |
| 3,992,995 | 11/1976 | Wiedermann | 102/6 X |
| 3,994,226 | 11/1976 | Rakowsky et al. | 102/6 |
| 3,999,482 | 12/1976 | Bilek | 102/7.2 |
| 4,005,655 | 2/1977 | Kleinschmidt | 102/4 |
| 4,132,169 | 1/1979 | Gay et al. | 102/6 |
| 4,167,140 | 9/1979 | Biseröd | 102/90 X |

OTHER PUBLICATIONS

Oak Leaf, *White Oak designs SLUFAE fuse,* vol. 33, #16, 8/5/77.

Army R&D, *SUFAE: Long-Range Minefield Breaching System Tested,* Dennis, vol. 17, May-Jun. 1976.

*Primary Examiner*—Peter A. Nelson

*Attorney, Agent, or Firm*—R. S. Sciascia; W. Thom Skeer; Kenneth G. Pritchard

[57] ABSTRACT

A fuel-air explosive weapon launched from a remote distance is used for clearing minefields. A set timing pattern in the operation of the minefield clearance round permits varied range through retarding the length of time that a programed sequence of events occurs at the launch site. Upon flight, the round follows a predetermined pattern in deployment of a parachute, firing cloud detonators and initiation of a burster charge. An extendable probe at the front of the round permits detonation at a predetermined level above ground. The descent by parachute provides a relatively stable launching platform for cloud detonators if they are fired prior to the burster charge detonation for dispersal of the fuel-air cloud.

13 Claims, 7 Drawing Figures

36
14
68
68
104
102
102
106
106
108
108
44
100

SURFACE-LAUNCHED FUEL-AIR EXPLOSIVE MINEFIELD CLEARANCE ROUND

BACKGROUND OF THE INVENTION

1. Field of the Invention

This invention pertains to minefield clearance devices. In particular, it permits remote clearing of a minefield by a fuel-air explosive weapon.

2. Description of the Prior Art

In phases of recent wars, up to 70% of tank and vehicle casualties and 35% of personnel casualties were caused by enemy minefields and booby traps. The effectiveness of such weapons has placed a high priority on the use of remote minefield clearing techniques to permit effecient deployment of combat personnel and equipment.

Current methods of breaching minefields includes hand emplacement of demolition charges, use of tanks for pushing or propelling linear explosive charges, mechanical clearing devices and foot soldiers with bayonets. These methods are slow and extremely dangerous. These methods require men and vehicles on the minefield exposed to enemy fire.

Present techniques of clearing enemy minefields permit the enemy to observe such activity. This provides a relatively long reaction time for the enemy to counter such penetration and clearing threats.

SUMMARY OF THE INVENTION

The present invention permits a stand-off or long-range minefield breaching capability which is highly mobile. The present invention is capable of being fired from a conventional personnel equipment carrier type vehicle and is suitable for being carried in multiple rounds on such a vehicle. The long-range stand-off capability is provided by the use of a rocket motor which propels the warhead section over the distance required to provide reasonable protection for the units employing the minefield clearance round. A fuel-air explosive in the warhead permits all pressure sensitive and trip wire activated mines in a given area to be cleared by a single round. This reduces the time needed for conventional mine by mine clearance methods. Such a fuel-air explosive warhead creates a highly volatile cloud over a section of the minefield. Detonation of this cloud produces high pressure under the cloud which results in triggering of the mines.

DESCRIPTION OF THE PREFERRED EMBODIMENT

Figure 1:
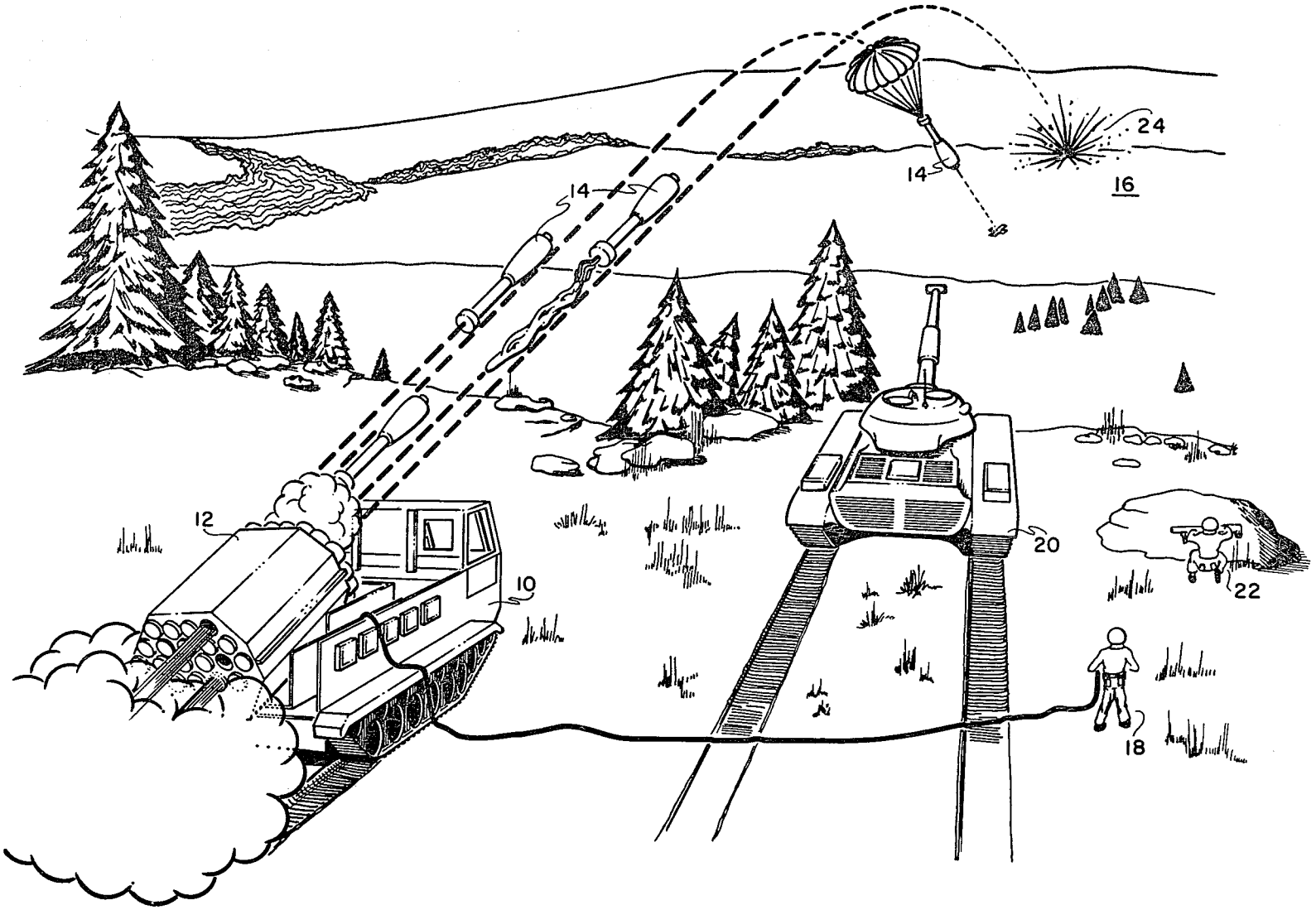
FIG. 1 is an example of an operational launching of the present invention to clear a minefield.

In FIG. 1, a launching vehicle 10 containing a launching system 12 with a multiple number of minefield clearance rounds 14 is shown in operation. As shown in FIG. 1, the minefield area 16, which is desired to be cleared, is at a remote distance from the launch vehicle 10 and its operator 18. By not requiring the physical presence of operator 18 in minefield 16, operator 18 is protected by assault units 20 and 22, which are awaiting clearance of the minefield to proceed. Round 14 creates fuel-air explosive cloud 24 which is then detonated. The detonation of cloud 24 creates a pressure impulse over the ground beneath the cloud which triggers pressure sensitive mines present.

Figure 2:
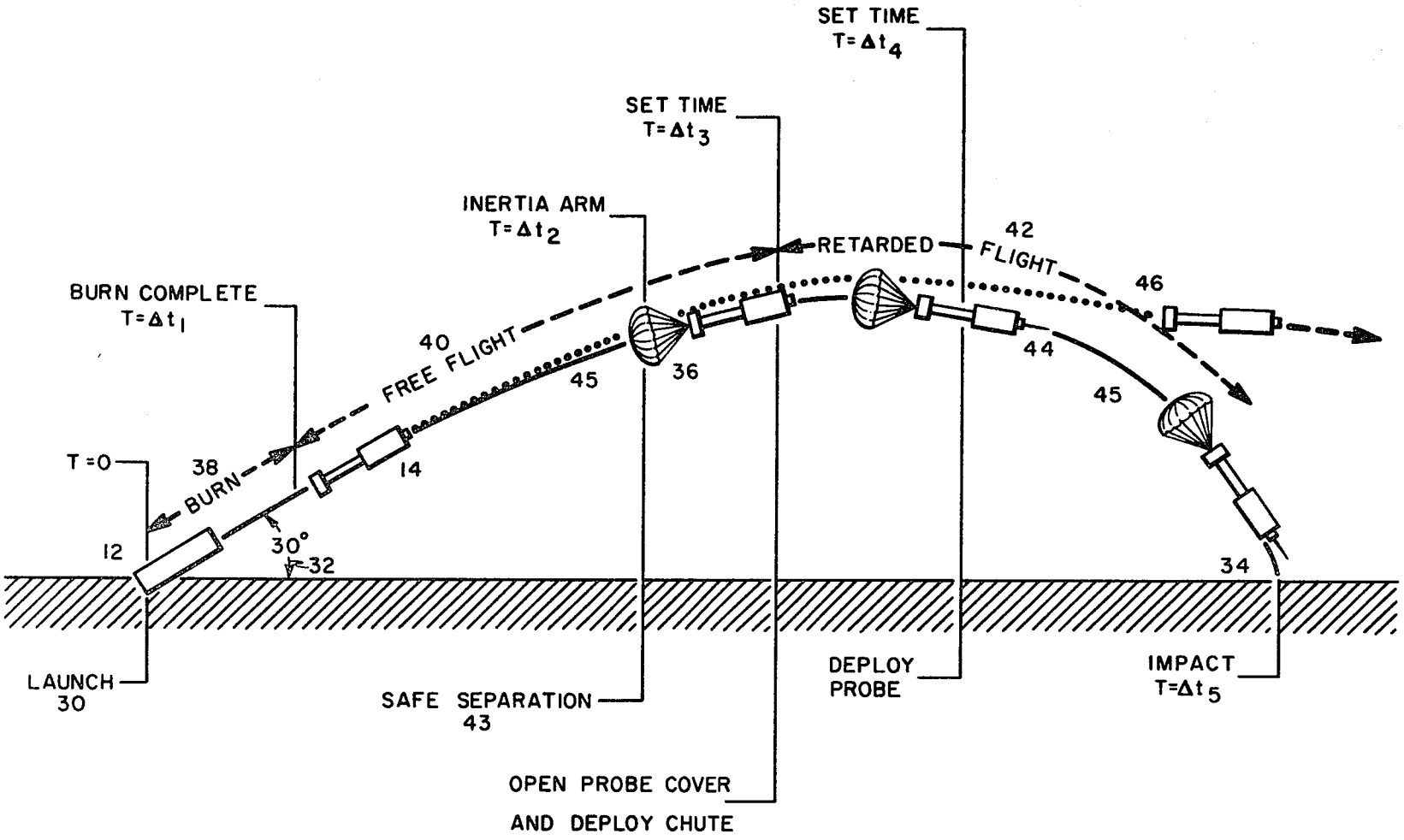
FIG. 2 is a cross-section of a clearance round flight path.

FIG. 2 shows the flight event profile of a single round. Round 14 is fired from launch point 30 at a predetermined angle 32 which for purposes of example is shown as 30°. The importance of launch angle 32 is that by always launching at a set angle the only orientation that is necessary to place the round on target is the actual pointing of launch vehicle 10 as shown in FIG. 1. Since clearance of a minefield requires more than one aim point to be cleared, it is obvious that different rounds are desired to impact at different points. The ideal method of breaching a minefield is to clear a straight path through the minefield for permitting rapid advancement of assault personnel and vehicles. This can be provided in the present invention by slowing round 14 through use of a parachute 36 as shown. If parachute 36 was always to deploy at the same time frame on each round, each round would impact at the same target point 34. However, in the present in the present invention, by varying the deployment time of parachute 36 to earlier and earlier times in subsequent rounds, it can readily be seen that each succeeding round, as shown in FIG. 1, will impact at a shorter range than the preceding round. Through the appropriate selection of changing time frame, these rounds can overlap and provide a straight line breach through a minefield. Each round will clear an area that is circular in shape. By overlapping these areas as described, a breach approximately as wide as the diameter of the circular area cleared by a single round and as long as the number of overlapping rounds will be cleared. If higher assurance of a breach is desired, multiple rounds per air point can be fired. The maximum range of the breach is limited to the overall maximum range of round 14.

Referring back to FIG. 2, it can be seen that the flight can be considered to have three phases;

- a burn phase 38 during which time the entire propellant fuel of the rocket motor is consumed,
- a free flight phase 40 during which the round follows a ballistic path, and
- a retarded phase 42 which is characterized by the deployment of parachute 36.

Round 14 is launched from launching system 12 at a time, T=O. Burn phase 38 will commence at T=O and last a period $\Delta t_1$. $\Delta t_1$ will be of very short duration, a few tenths of a second only. This is a requirement based on the empirical fact that the amount of course deviation is proportional to the length of the burn time.

Upon completion of the burn time, the rocket fuel is consumed and round 14 enters ballistic flight. During this phase of flight it is desirable to complete arming of the warhead on the rocket. By not arming the warhead until after launch, a safe separation distance 43 reached at time $\Delta t_2$ is provided in case of warhead detonator malfunction. The ballistic or free flight phase 40 terminates upon deployment of parachute 36 at time $T=\Delta t_3$. At this same time, a probe cover is removed, starting a probe deployment timer. Probe deployment will be discussed further on. Parachute 36 slows round 14 causing retarded flight path 42 to be followed to impact point 34. During this retarded phase, a probe 44 will be deployed at a time $T=\Delta t_4$. Impact point 34 will be in contact with probe 44 at time $T=\Delta t_5$. The ideal flight event profile follows solid line 45. A malfunction in flight will cause round 14 to follow dotted path 46 which overshoots the minefield. Failure of parachute 36 to deploy will cause round 14 to be considered a dud. For reasons which will be explained shortly, round 14 requires a successfully deployed parachute to function properly.

Figure 3:
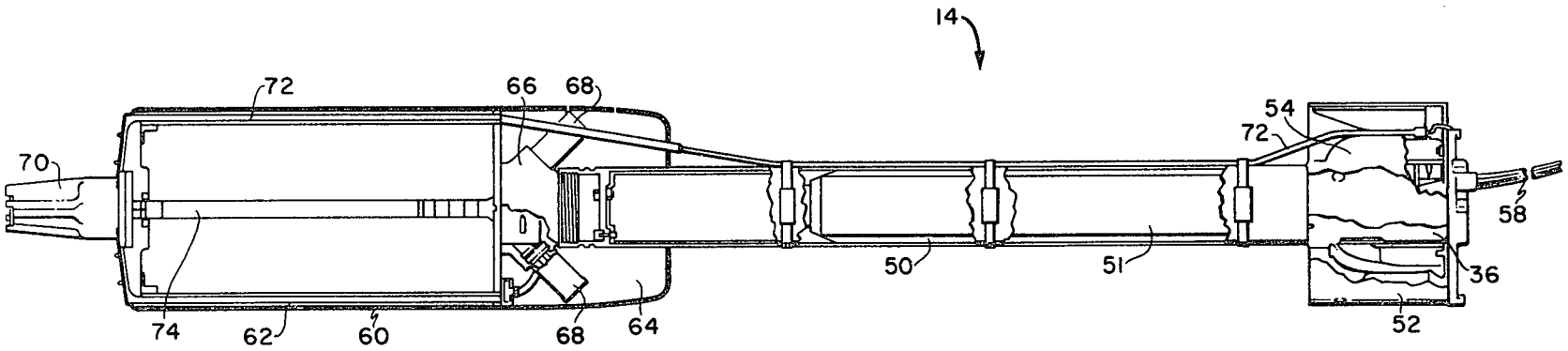
FIG. 3 is a schematic of a clearance round.

A general schematic of clearance round 14 is shown in FIG. 3. Round 14 consists of a rocket motor 50 shown with cut-away section which provides the thrust requred to launch the round. Rocket motor 50 burns a propellant 57 in the normal fashion. In analysis and tests to detemine the accuracy of such a round, it has been found that the rocket motor should be of relatively short duration in burning time to provide minimum possible deviation from thrust malalignment. It has been found that a burning rate of 1.1 inches per second with a chamber pressure of approximately 2,000 psi at ambient temperature of 70° F. to 77° F. has provided the optimum tradeoff between deviation of a rocket due to uneven burning which increases as burning time increases and the risk of rocket motor failure due to blowup which increases as the chamber pressure increases. The specific parameters cited are considered exemplary only and can be modified or changed if other tradeoffs such as thrust control, level of rocket motor pressure and so forth are varied. Due to the relative shortness of the overall rocket motor length it has been found that a moderately fast burning propellant is sufficient if it provides the above characteristics. A propellant based on a binder of hydroxyl terminated polybutadiene has been found to provide reliable propellant characteristics.

Attached to rocket motor 50 is a fin assembly 52 which provides stable flight during the free flight phase of the round's trajectory. Fin assembly 52 has a compartment 54 which houses parachute 36. At the rear of the round, wiring connector 58 provides the command signals to the rocket for initiation of performance and signal communication to the electronic fuze 70.

Mounted at the front of rocket motor 50 is a warhead 60. Warhead 60 is shown having two compartments or sections. The first section 62 contains a fuel-air explosive which can be any appropriate liquid for creating a fuel-air explosive cloud such as liquid propylene oxide. The second section 64 contains the secod event package (SEP) chamber 66 which launches two cloud detonators 68 referred to as CD's. When the round is descending at the end of parachute 36, it can be seen that CD's 68 are angled to launch in an upward and outward direction from round 14.

On the forward end of warhead 60, is a programmable fuze 70. Fuze 70 provides all the timing functions for round 14. By making fuze 70 programmable, selected timing sequences can be varied. Fuze 70 is connected through a wiring connection 72 to the fire control circuit. The means for launching parachute 36, SEP chamber 66 and burster charge 74 which is to disperse the fuel-air expolsive contained in section 62 are explosively connected to the fuze 70. To provide simplicity in the functioning of the round, fuze 70 is set on a predetermined time sequence for each round. The range of round 14 will be determined by the amount of time round 14 will be in fight prior to the deployment of parachute 36. This is varied by starting the fuze timing sequence on a 12 second countdown while it is still contained within launcher 12. For example, suppose only 50% of round 14's maximum range is desired. After fuze 70 receives its initial impulse signal, through wiring connector 58, round 14 will remain in launcher 12 for a predetermined time, approximately 7 seconds, until the firing signal at $T=0$ is received. This is done by delaying the launch until the desired time lag has elapsed. Upon launch, in reference back to FIG. 2, it can be seen that the burn time will remain a constant to provide the initial impulse to provide flight to round 14. What is controlled is the length of time spent in free flight 40 until he deployment of parachute 36. Upon depolyment of parachute 36, which can be accomplished by use of a mild detonating cord to blow a protective cover on compartment 54, the parachute will deploy and slow round 14. Fuze 70 may use an extendable probe, not shown, to trigger the cloud formation at an optimum height above ground. If deployed prior to launch, such a probe would be subject to shearing through high aerodynamic drag during the launch phase of round 14. A compacted probe also permits greater ease in handling prior to launch. Thus fuze 70 will provide a second timing function to permit extension of the probe after parachute 36 has had adequate time to deploy and slow round 14 to a speed which does not pose any threat to such a probe.

Upon the probe's contacting the ground, fuze 70 then causes the impulse to CD's 68 which are launched at an upward and outward angle away from round 14. The use of the two CD's permits a backup reliability in detonating a fuel-air cloud. Fuze 70 will further have a time delay from the launch of CD's 68 to the initiation of burster charge 74. This permits CD's 68 to launch from a stable platform and not be disrupted by the functioning of burster charge 74. Detonating of burster charge 74 increases the internal pressure within section 62 of the warhead until the walls rupture permitting formation of a fuel-air cloud. The flight path of CD's 68 is designed to have them immersed in this cloud when it is formed. The CD's provide a delay in detonation of the cloud until it has adequate time to form over the desired impact area.

Figure 4:
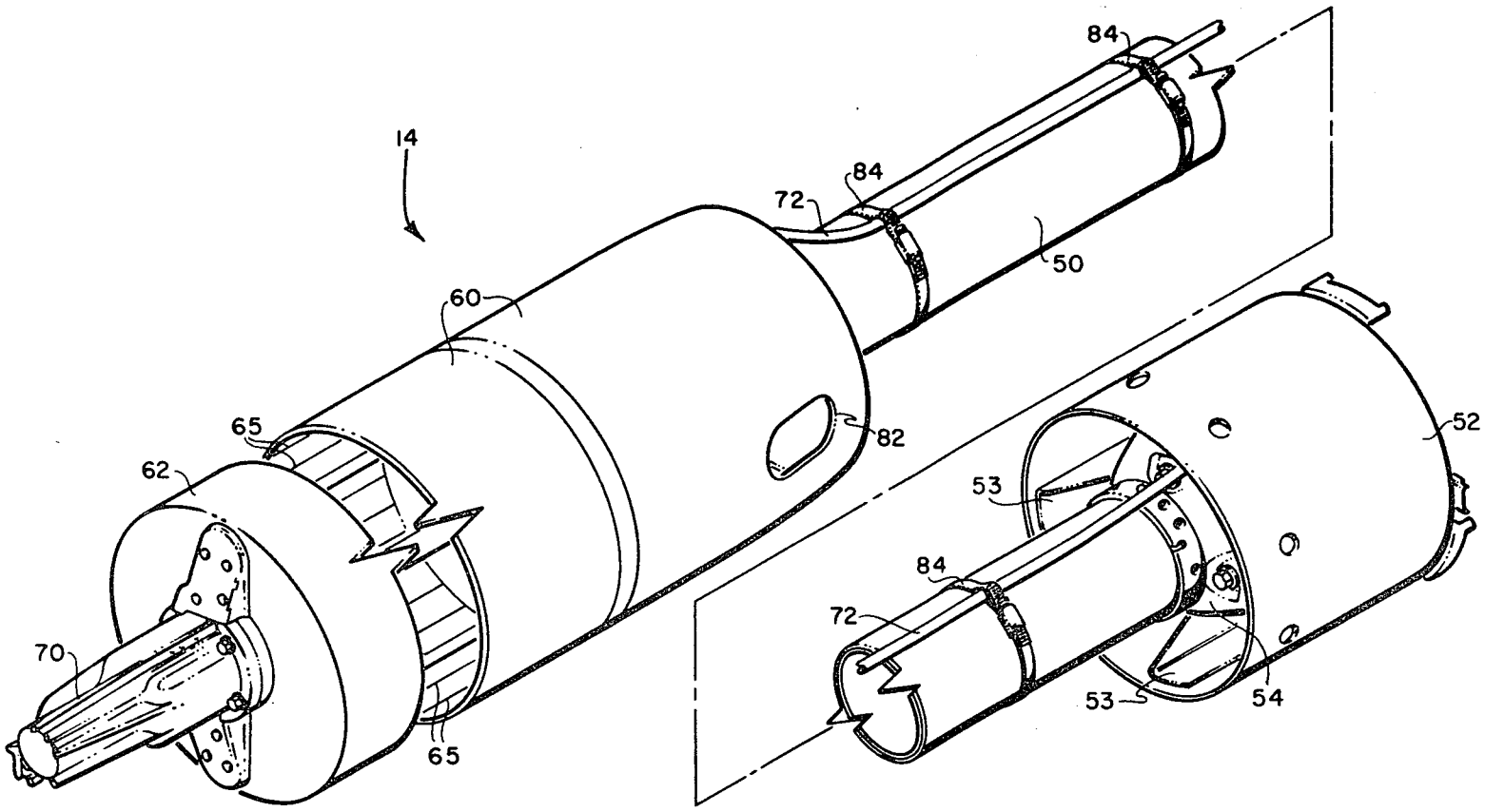
FIG. 4 shows a breakaway version of a preferred embodiment of the present invention.

FIG. 4 shows a divided external view of round 14. As shown in FIG. 4, like numbers refer to like parts previously discussed. Fuze 70 is shown mounted at the front of warhead 60. A cover 80 at the front of fuze 70 protects the extendable probe shown in FIG. 2 until the appropriate time for deployment. The appropriate time is after the parachute has slowed the round to a speed where wind resistance would not damage the probe. CD's 68, shown in FIG. 3, are launched through ports 82 in the upper section 64 of warhead 60. The lower section 62 of warhead 60 contains the fuel-air exploxive. An internal slice of section 62 is shown with groves 65 cut into the side of section 62. Groves 65 permit a predetermined rupture pattern to oocur. Communiction link 72 is shown strapped externally to rocket motor 50 by straps 84. Fin assembly 52 with parachute compartment 54 is shown with bolts 86 which provide the connections to parachute 36 which support round 14 during its descent by parachute.

Figure 5:
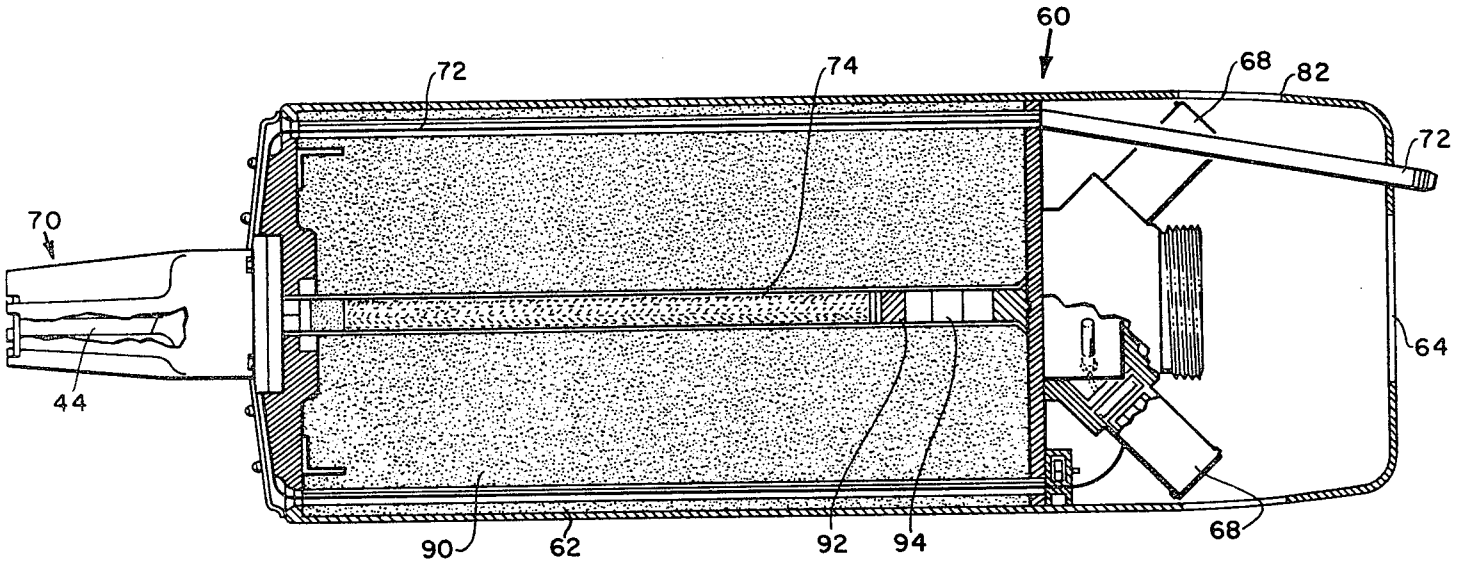
FIG. 5 is a cross-section of the warhead section of the present invention.

FIG. 5 shows a cross-section of the warhead assembly. Fuel-air explosive 90 is shown contained within section 60 of the warhead. Fuze 70 through its timing sequence will first launch CD's 68 through ports 82 a few milliseconds prior to the initiation of burster charge 74. Probe 44 is shown within fuze 70 in a compacted state. Probe 44 extends after round 14 has been slowed and wind damage is not a threat. Since probe 44 is made of lightweight material, wind resistance during launch could shear it off or deform it. The walls of section 60 will have grooves 65 cut in the sides, as shown in FIG. 4, to provide predetermined weak points which will rupture. By having the walls rupture at predetermined points, a predictable cloud pattern will form when internal pressure of wardhead section 62 is increased beyond a predetermined level by burster charge 74.

When section 62 bursts, fuel-air explosive 90 will be trying to expand in all directions. Expansion in the vertical direction to the ground is not desired because it reduces the surface beneath the cloud and thus the area that will be cleared of mines. To limit this effect and improve the efficiency of outward expansion, a steel slug 92 is placed in front of a rubber cushion 94 at the end of burster charge 74. Steel slug 92 helps direct the pressure from burster charge 74 to a direction parallel to the ground surface. Rubber cushion 94 provides a means for controlling the difference in expansion of burster charge 74 and warhead metal parts during heating.

Previously, fuel-air explosive weapons have had the detonators embedded in the fuel to provide predictable position of the detonators in the fuel-air cloud. For a surface-launched fuel-air explosive, placement of the detonators within the cloud has proven unreliable, since fuel 90 is subject to expansion and contraction depending on the ambient temperature of its surroundings. This results in changing the fuel level above detaontors. This in turn results in a limited minimum temperature, (approximately 0°), in which the weapon will function. The present invention avoids this problem by giving the detonators a predetermined flight pattern independent of expansion or contraction of fuel 90 in section 62 prior to initiation of the minefield clearance round.

Figure 6:
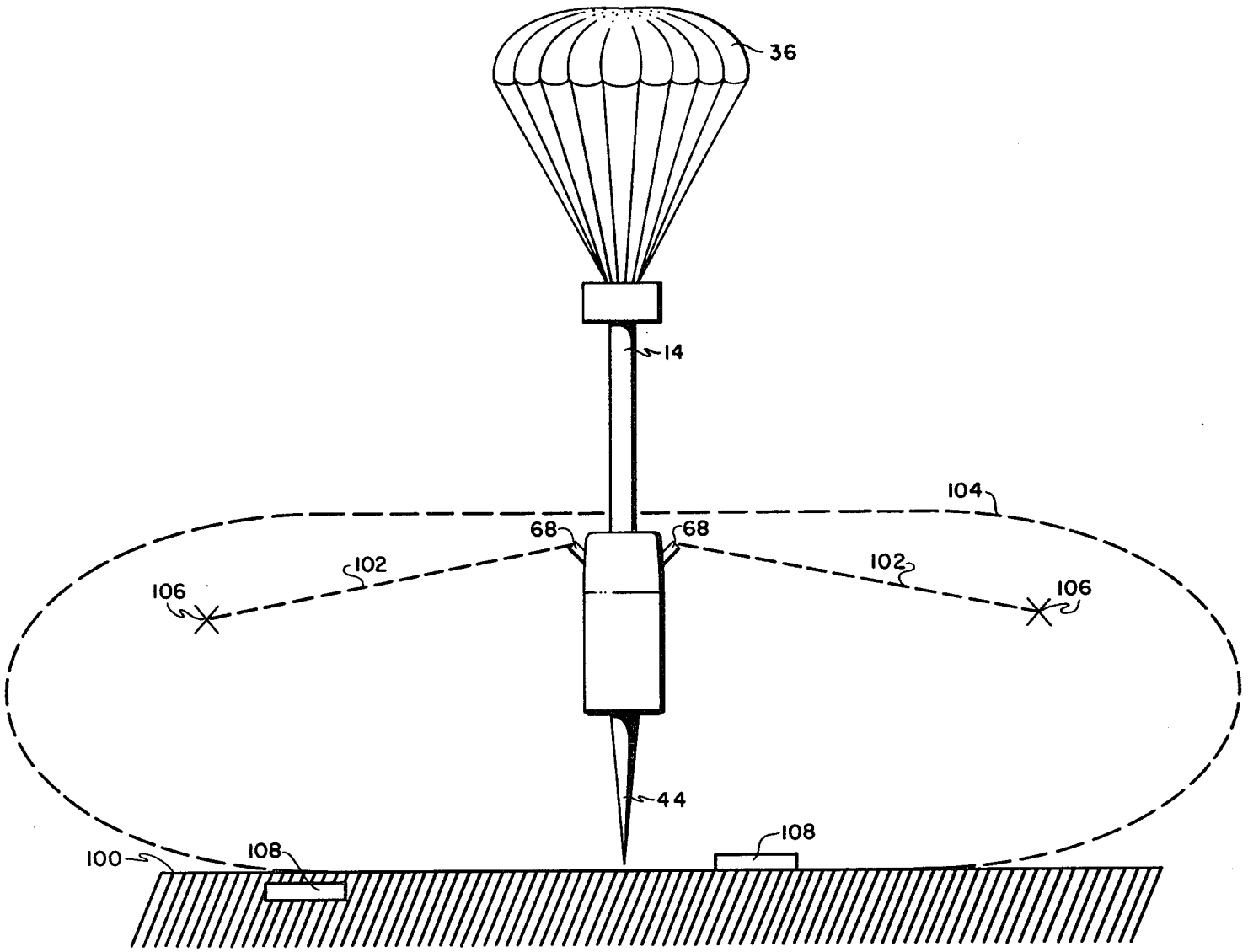
FIG. 6 is a view of cloud formation at impact.

FIG. 6 shows a profile of round 14 which first strikes the ground 100 through extended probe 44. The probe length should be long enough to permit almost complete cloud formation above the ground. CD's 68 are launched along paths 102 and detonate at points 106. Empirically a launch angle of 55° has been found to produce optimum results. The firing of burster charge 74 expands fuel 90 to form a cloud roughly of the shape 104 shown. Upon immersion of CD's 68 into cloud 104, detonation of cloud 104 occurs causing mines 108 which are shown on or beneath the ground to be detonated by the pressure from the explosion of cloud 104.

Figure 7:
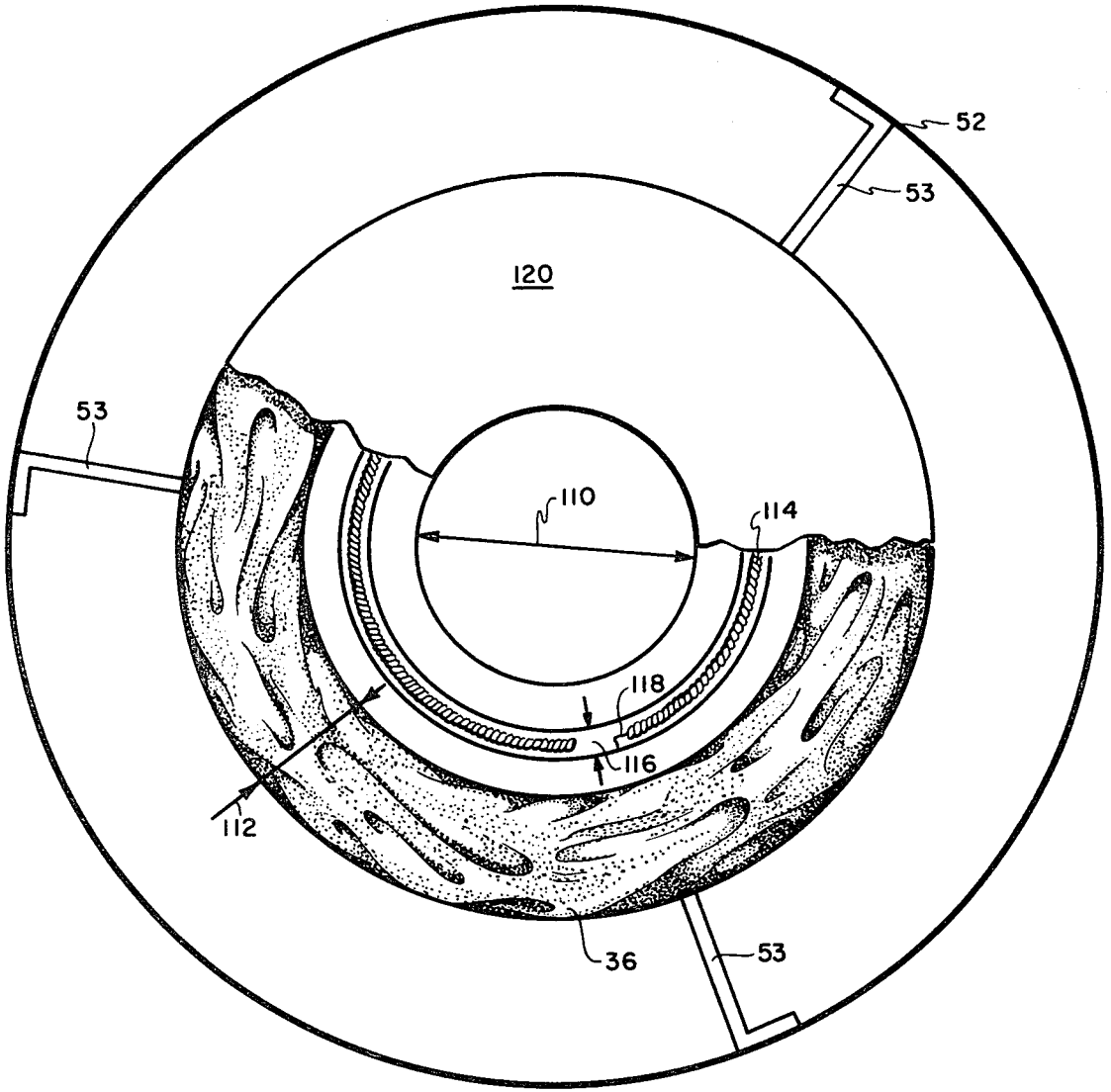
FIG. 7 is a rearview of clearance round.

FIG. 7 shows the exhaust end of round 14. Rocket motor 50 has an interior diameter 110. Parachute 36 is packed in a compartment 112 which is concentric with rocket motor 50 and physically attached to the exterior of rocket motor 50. Attached to compartment 112 by welding or other suitable means are struts 53 which in turn support fin 52. To deploy parachute 36, a releasing means is used. In FIG. 7, the releasing means is a mild detonating cord 114 contained in a groove 116. Cord 114 is initiated by the fuze. Compartment 112 is covered by a donut shaped lid 120 shown in a breakaway view. Detonation of cord 114 jettisons lid 120 which in turn deploys parachute 36.

The sequence of events for a successful launch of the present invention is as follows:

the fuze timing sequence is started while the round is still in the launcher;

after a predetermined delay the rocket motor is ignited and the G load of launch starts the arming sequence to arm the warhead;

after the fixed burn time, the round enters free flight which permits completion of warhead arming by inertia at a safe distance from the launch point;

at the end of the fuze timing sequence the parachute is deployed and the probe cove jettisoned;

at a fixed time after the parachute has deployed and slowed the round, the probe is deployed;

upon the probe contacting the ground, a signal to launch the cloud detonators is sent by the fuze and the cloud detonators are launched; and after a brief time lapse to permit the cloud detonators to clear the SEP chamber, the burster charge is detonated and dispurses the cloud which in turn is detonated by the cloud detonators.

What is claimed:

1. A fuel-air explosive minefield clearance round for triggering mines in a target area comprising:

a rocket motor for propelling said round to the target area from a predetermined location;

a fin assembly connected to the rear of said rocket motor for stabilizing said round in flight, such that said round follows a predetermined path to the target area;

a parachute contained within said fin assembly for slowing said round prior to termination of said round's arrival at said target area;

a warhead connected to said rocket motor for containing said fuel-air explosive during travel of said round to said target area;

a burster charge container within said warhead for dispersing said fuel air explosive over said target area;

a detonator assembly contained within said warhead for detonating said dispersed fuel, such that said detonator assembly is independent of ambient temperature of said fuel;

a fuze operatively connected to said burster charge, detonator assembly and parachute; and an extension probe of predetermined length connected to said fuze for sensing when said warhead is a predetermined distance above the ground, said probe extending afte the slowing of said round by said parachute to avoid damage to the probe due to wind shear.

2. a fuel-air explosive minefield clearance round as described in claim 1 wherein said rocket motor has a propellant which comprises:

a hydroxyl terminated polybutadiene binder with additives which produce approximately 2000 psi within the chamber of said rocket.

3. A fuel-air explosive minefield clearance round as described in claim 1 wherein said fuze has a variable timing sequence for controlling the predetermined range at which said round will impact.

4. A fuel-air explosive minefield clearance round as described in claim 1 wherein said parachute is deployed by releasing means triggered by said fuze.

5. A fuel-air explosive minefield clearance round as described in claim 1 wherein said burster charges further comprises a steel slug and rubber cushion positioned such that said steel slug is impelled into said rubber cushion upon detonation of said burster charge for improving the efficiency of cloud formation, said efficiency measured by the total surface area of ground covered by said cloud.

6. A fuel-air explosive minefield clearance round as described in claim 1 wherein said detonator assembly further comrpises a pair of cloud detonators launched at an upward and outward angle upon said probe contacting the ground, said cloud detonators launched a predetermined period of time prior to the firing of said burster charge such that said detonators are clear of the warhead prior to the firing of said burster charge.

7. A fuel-air explosive minefield clearance round as described in claim 6 where said upward and outward angle of launching said cloud detonators is 55° elevated above the horizontal.

8. A fuel-air explosive minefield clearance round as described in claim 4 wherein said parachute releasing means comprises a mild detonating cord.

9. A fuel-air explosive minefield clearance round as described in claim 1 wherein said warhead further comprises:

a compartment containing said fuel air explosive with grooves cut into the sides of said compartment for creating a predetermined rupture pattern when the interior pressure of said compartment exceeds a predetermined level;

a burster charge centrally located within said compartment and connected to said fuze for creating pressure in said compartment greater than said predetermined rupture level; and a separate events package chamber within said warhead connected to said fuze for launching at least one cloud detonator at an upward and outward angle with respect to the horizontal of said descending warhead at a predetermined time prior to the triggering of said burster.

10. A fuel-air explosive minefield clearance round as described in claim 9 wherein said warhead further comprises:

a slug at one end of said burster charge for improving the efficiency of said burster charge in cloud formation; and a cushion at the opposite side of said slug from said burster charge for controlling the deformation and heating of said slug when said burster charge is detonated.

11. a fuel-air explosive minefield clearance round comprising:

a rocket motor for propelling said round to a predetermined target;

a fin assembly with a compartment connected to the rear of said rocket motor for stablizing said round in flight, such that said round follows a predetermined path to said target;

a parachute contained in said fin assembly during the launching of said round which is deployed after a predetermined time period for slowing said round such that it descends in a predetermined manner on said target;

a warhead divided into two sections, the first section containing said fuel air explosive and having grooves cut into the sides of said first section creating a predetermined rupture pattern when the interior pressure of said first section exceeds a predetermined level;

a detonator assembly within said second section of said warhead for launching at least one detonator at an upward and outward angle of approximately 55° with respect to the horizontal of said descending warhead when said parachute is deployed;

a burster charge centrally located within said first section of said warhead for creating pressure greater than said predetermined rupture level;

a fuze with a variable timing sequence operatively connected to said parachute, detonator assembly and burster charge for controlling each of said connected items to function at a predetermined time and in a predetermined sequence; and an extension probe of predetermined length connected to said fuze for sensing when said warhead is a predetermined distance above the ground, said probe extending after the slowing of said round by said parachute to avoid damage to the probe due to wind shear.

12. A fuel-air explosive minefield clearance round as described in claim 11 wherein said rocket motor has a propellant which comprises:

a hydroxyl terminated polybutadiene binder with additives which produce approximately 2000 psi within the chamber of said rocket.

13. A fuel-air explosive minefield clearance round as described in either of claims 1, 2, 3, 6, 9, 10 or 11 wherein said fuel-air explosive comprises liquid propylene oxide.

* * * * *